United States Patent [19]

Vachhani et al.

[11] 4,210,379

[45] Jul. 1, 1980

[54] MODULAR BARRIER BLOCK

[75] Inventors: Vasantrai A. Vachhani, Kernersville; Melvin A. Soderstrom, Advance; Richard L. Hughes, Clemmens, all of N.C.

[73] Assignee: AMP Incorporated, Harrisburg, Pa.

[21] Appl. No.: 20,774

[22] Filed: Mar. 15, 1979

[51] Int. Cl.[2] ..... H01R 13/56

[52] U.S. Cl. ..... 339/101; 339/59 M; 339/217 S

[58] Field of Search ..... 339/101, 18, 47 C, 59 M, 339/103 C, 103 M, 113 R, 113 B, 198 S, 214 R, 217 S, 258 F, 273 F

[56] References Cited

U.S. PATENT DOCUMENTS

| | | | |
|---|---|---|---|
| 2,478,143 | 8/1949 | Watts | 339/47 C |
| 2,909,756 | 10/1959 | Sitz | 339/59 M X |
| 3,172,720 | 3/1965 | Teuscher et al. | 339/217 S X |
| 4,085,989 | 4/1978 | McCardell | 339/59 M |

*Primary Examiner*—Roy Lake
*Assistant Examiner*—DeWalden W. Jones
*Attorney, Agent, or Firm*—Gerald K. Kita

[57] ABSTRACT

A barrier block is disclosed which incorporates an electrical terminal in the form of a hollow cylindrical barrel provided with a longitudinal slot divided into one or more pairs of wire gripping jaws. The barrel is integral with a second electrical contact connected to the barrel by an integral loop serving as a sloped wire stop at the entry of said barrel. Each electrical terminal is mounted on a web which interconnects partition walls. One of the partition walls is provided with a hook and a latch. Another partition wall is provided with a hook receiving recess and a latch receiving recess allowing a plurality of barrier blocks to be hooked and latched together.

5 Claims, 15 Drawing Figures

Fig. 2
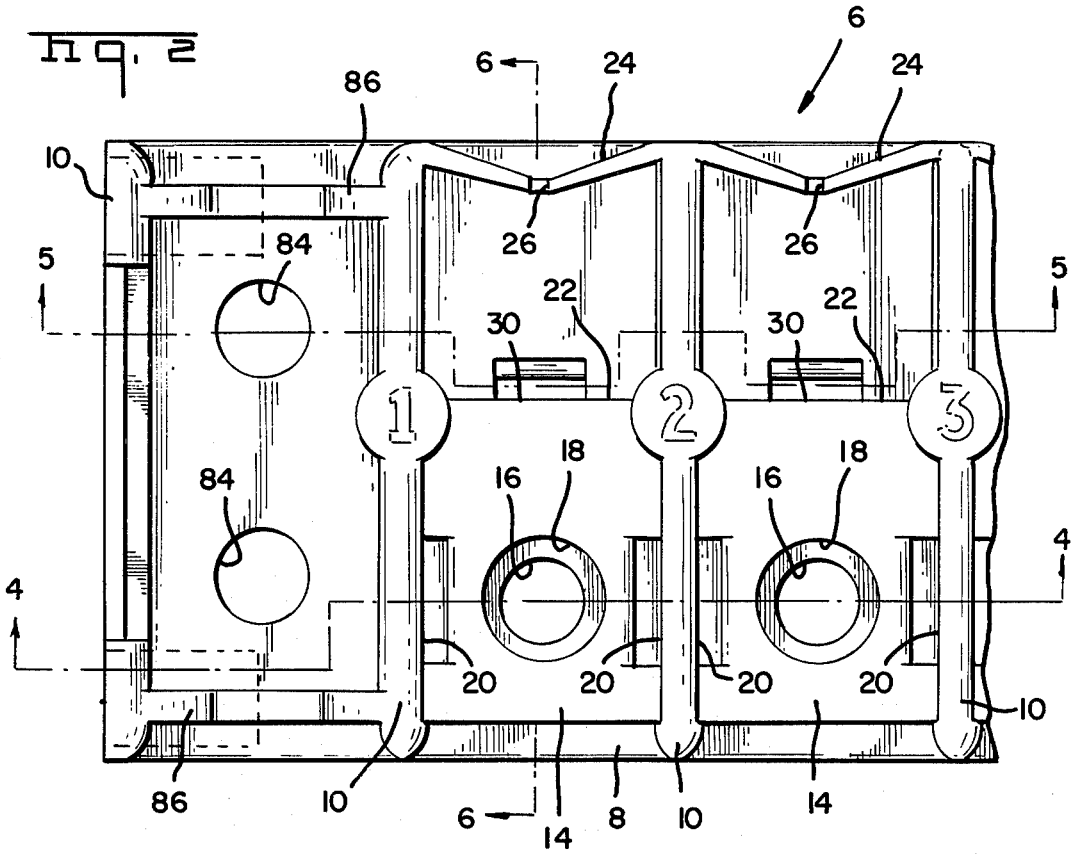
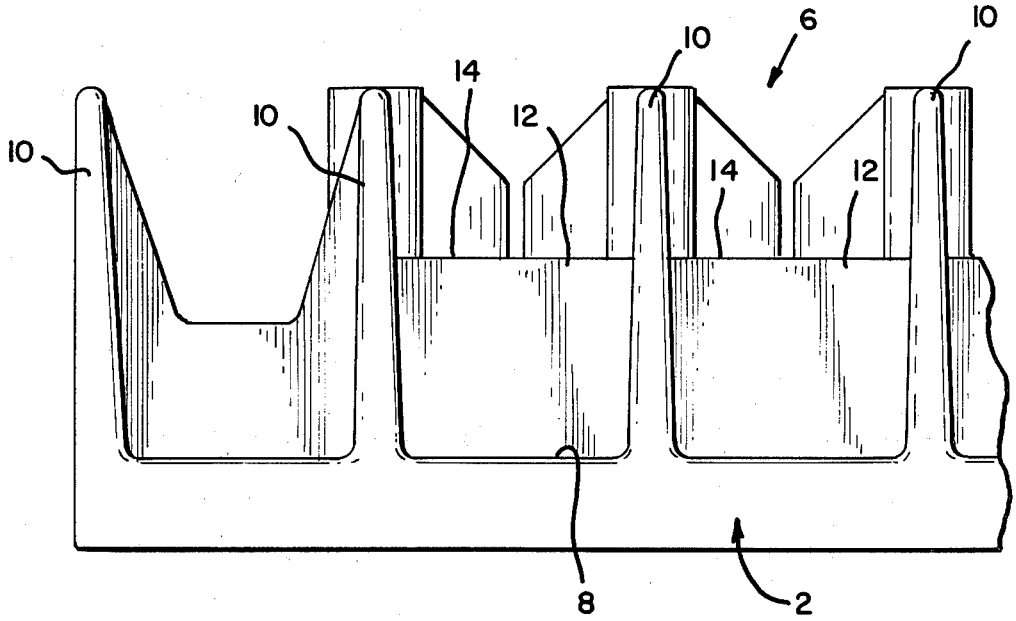
Fig. 3

Fig. 4
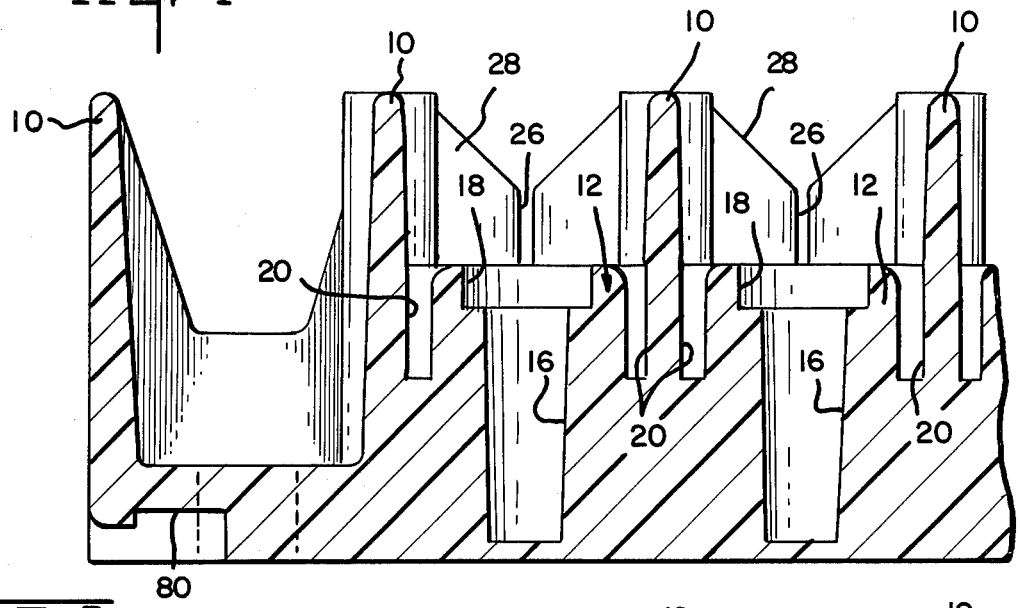
Fig. 5
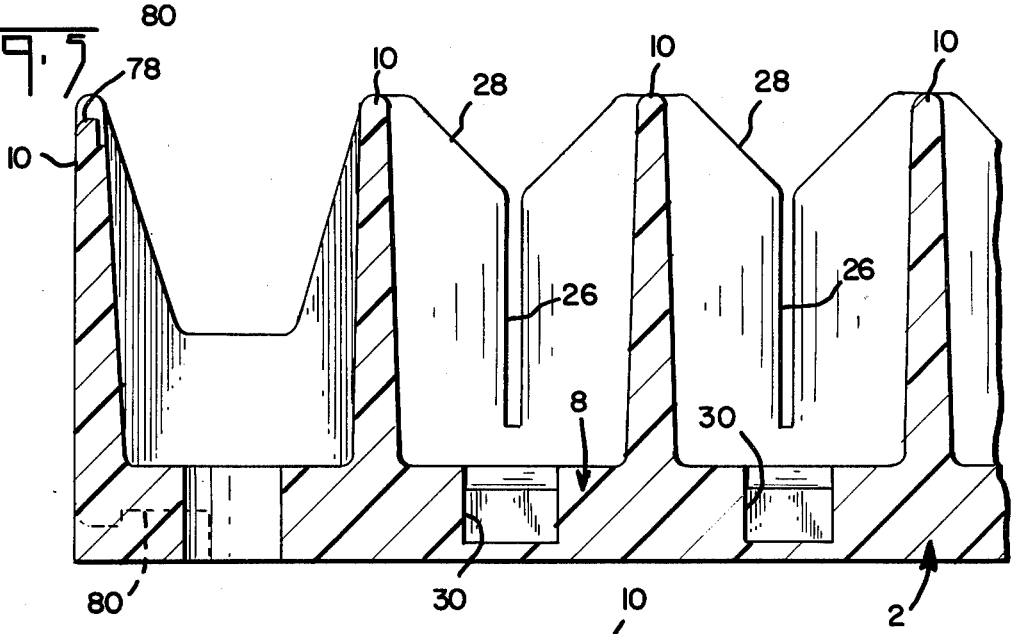
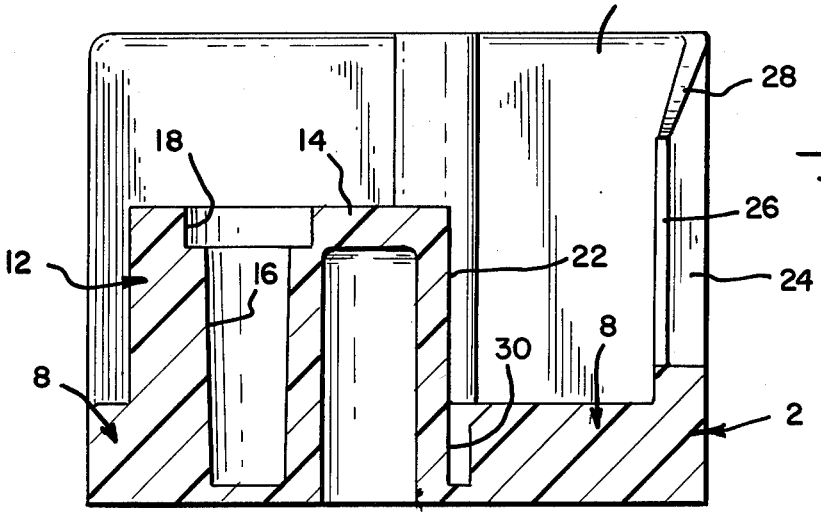
Fig. 6

54
42
4
48
46
44
46
32
38
12
2A
10
10
24
26

48
32
32
38
24'
12'
2B
10
10
24
26
8

70
68
64
54
66
42'
48
4A
44
32
38

12
2A
24
26

MODULAR BARRIER BLOCK

FIELD OF THE INVENTION

The invention relates to a junction block housing and a plurality of electrical terminals providing a central location to which wires are routed and electrically connected to one another with the terminals.

BACKGROUND OF THE INVENTION

A junction block is exemplified by U.S. Pat No. 2,909,756 wherein a junction block base molded from a dielectric material is provided with mounting lugs receiving screws which secure the housing to a circuit board or panel. Individiual wires are connected to electrical terminals mounted on the base. The wires are either directly attached to the terminals or are first connected to electrical contacts which are then secured to the terminals.

SUMMARY OF THE INVENTION

In a junction block according to the present invention individual barrel terminals are readily assembled to a junction block base by insert tabs. Barrels of different forms may be selected for assembly. The base is provided with a plurality of partition walls which serve as barriers between adjcent terminals. The partition walls further are molded with strain relief flanges which grippingly secure wires that are connected electrically to the terminals. Further, the barrier blocks are of module forms capable of being linked together to allow selection of any desired number of terminals and barrier blocks in a single stacked assembly.

Therefore, an object of the present invention is to provide a barrier block in which electrical terminals are readily assembled and in which modules of the barrier block are readily assembled together.

Another object of the present invention is to provide a barrier block module having a base provided with pairs of partition walls joined together by an interconnecting web into which an electrical terminal is readily assembled, with a pair or more of said modules capable of linking together to provide a selected number of terminals.

Another object of the present invention is to provide a barrier block in module form and capable of linking together with a like module form to provide a desired number of electrical terminals, the terminals themselves being selected from a number of desired forms which are readily assembled to the barrier block.

Another object of the present invention is to provide a modular barrier block incorporating an electrical terminal of the type having a cylindrical barrel provided with a longitudinal slot divided into one or more pairs of opposed wire engaging and gripping jaws, with partition walls of the barrier block providing strain relief flanges for gripping therebetween one or more wires electrically connected into the slot of the barrel.

Other objects and many advantages of the present invention will become aparent from the following detailed description and the accompanying drawings.

DRAWINGS

FIG. 2 is an enlarged fragmentary plan view of a base portion only of the barrier block shown in FIG. 1.

FIG. 3 is an enlarged fragmentary rear elevation of the base shown in FIG. 2.

FIG. 4 is an enlarged fragmentary elevation in section taken along the line 4—4 of FIG. 2.

FIG. 5 is an enlarged fragmentary elevation in section taken along the line 5—5 of FIG. 2.

FIG. 6 is an enlarged side elevation in section taken along the line 6—6 of FIG. 2.

FIG. 13 is an enlarged perspective of yet another embodiment of the module.

DETAILED DESCRIPTION

Figure 1:
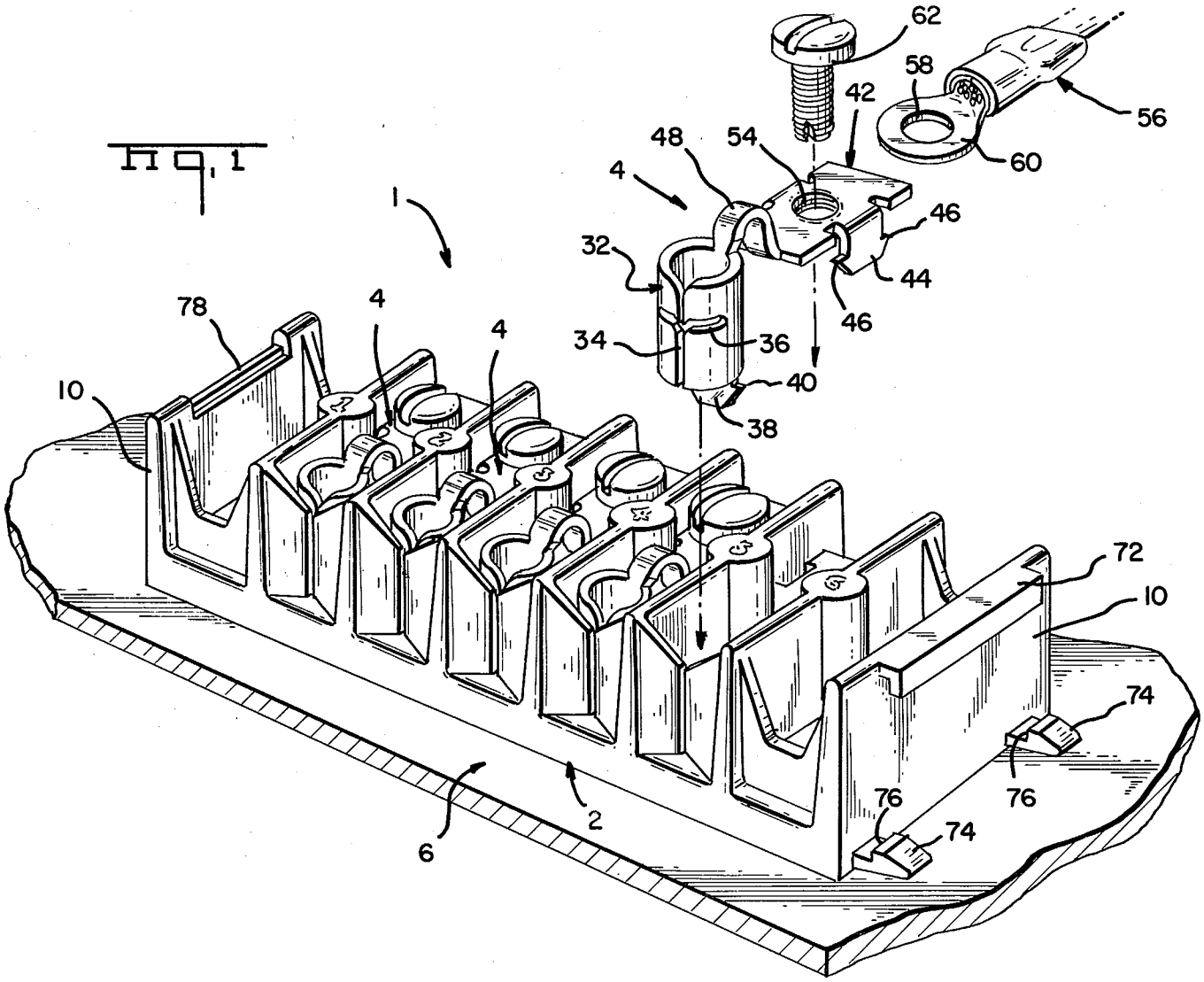
FIG. 1 is an enlarged perspective of a barrier block according to the present invention with selected components thereof in exploded configuration to illustrate the details thereof.

With more particular reference to the drawings, FIG. 1 illustrates a preferred embodiment of a modular barrier block indicated generally at 1 and including a base 2 which mounts a plurality of electrical terminals 4. The base is designed for mounting to a panel indicated generally at 6.

Details of the base are illustrated more in detail in FIGS. 2 through 6. The base is fabricated of a stiffly resilient dielectric material and is of unitary molded configuration with a bottom wall 8 and a plurality of generally rectangular partition walls 10. Adjacent partition walls 10 are interconnected b a vertically thick web 12 which provides a horizontal platform surface 14 in which is provided a relatively deep vertically tapered recess 16 having an enlarged counter bore 18 communicating with the platform 14. Relatively thin rectangular vertical cavities 20 are provided adjacent either side of a recess 16 and along side corresponding partition walls 10. The cavities 20 are terminal locking cavities as will be explained in detail.

As shown more particularly in FIGS. 2 and 6, each web 14 has a vertical sidewall 22 bridging across the partitions which are on either side of the web 14. The partitions further are joined by a thin web flange 24 which is in spaced relationship from a corresponding sidewall 22. Each flange 24 is bifurcated by a vertical slot 26, with the sides of the slot being parallel with each other for a substantial vertical distance, and then outwardly flaring away from each other to define a funnel entry 28 communicating with the slot. A top accessible cavity is defined between the slotted flange 26 and the sidewall 22, and further between adjacent partition walls 10. One end of the cavity is closed by the bottom wall 8 of the base. As shown in FIGS. 2 and 6, the bottom wall 8 is provided with a relatively thin rectangular cavity or recess 30 along side the sidewall 22 thereby to provide a terminal locking cavity in a manner to be described.

FIGS. 1 and 7–10 illustrate the details of the terminal 4. Each terminal 4 is stamped and formed from a single strip of conductive metal and is configured thereby with a hollow cylindrical barrel shaped electrical contact 32 generally of hollow sleeve form provided with a vertical longitudinal open seam or slot 34. Opposite sides of the slot 34 define wire engaging and gripping jaws. One or more transverse slots 36 divide the slot 34 into one or more pairs of opposed wire gripping jaws.

Figure 10:
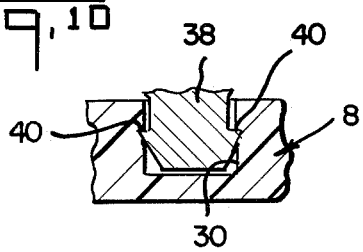
FIG. 10 is an enlarged fragmentary section taken along the line 10—10 of FIG. 7.
Figure 9:
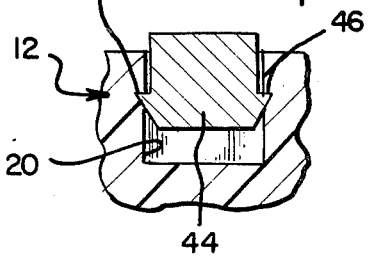
FIG. 9 is an enlarged fragmentary elevation taken along the line 9—9 of FIG. 8.

The barrel contact 34 is provided with a depending dovetail tab 38 having a pair of oppositely projecting wedge shaped teeth 40. FIG. 10 illustrates the teeth 40 biting into the bottom wall 8 of the base when the insert tab 38 is forcibly inserted into the recess 30.

Figure 7:
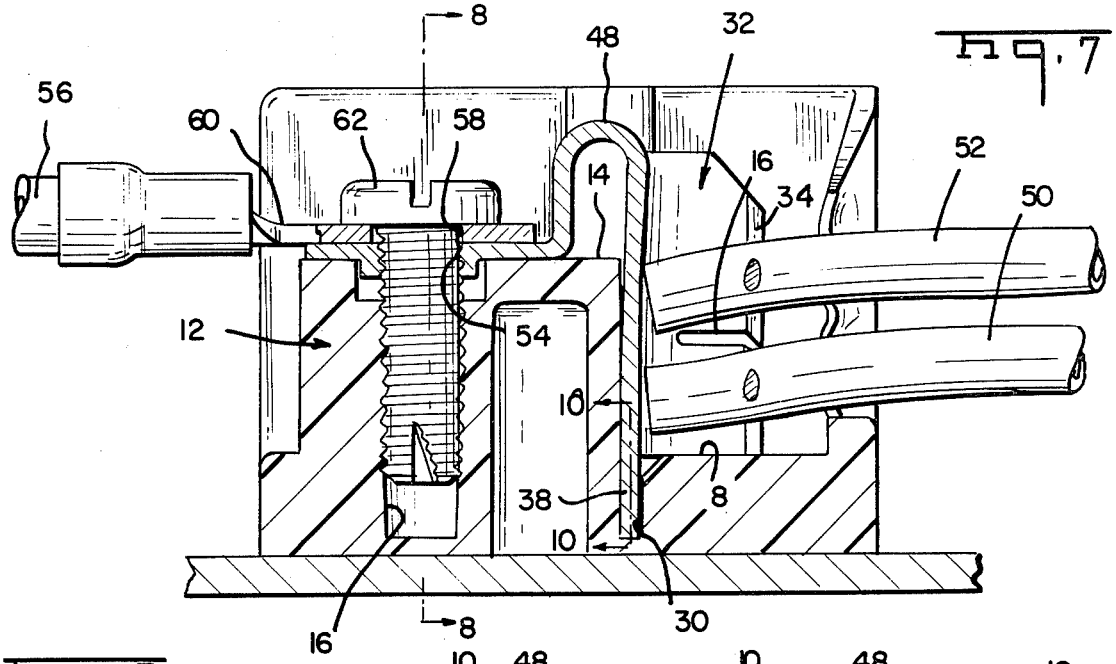
FIG. 7 is an enlarged elevation similar to FIG. 6 and further illustrating the component parts of the invention incorporated into the base.
Figure 8:
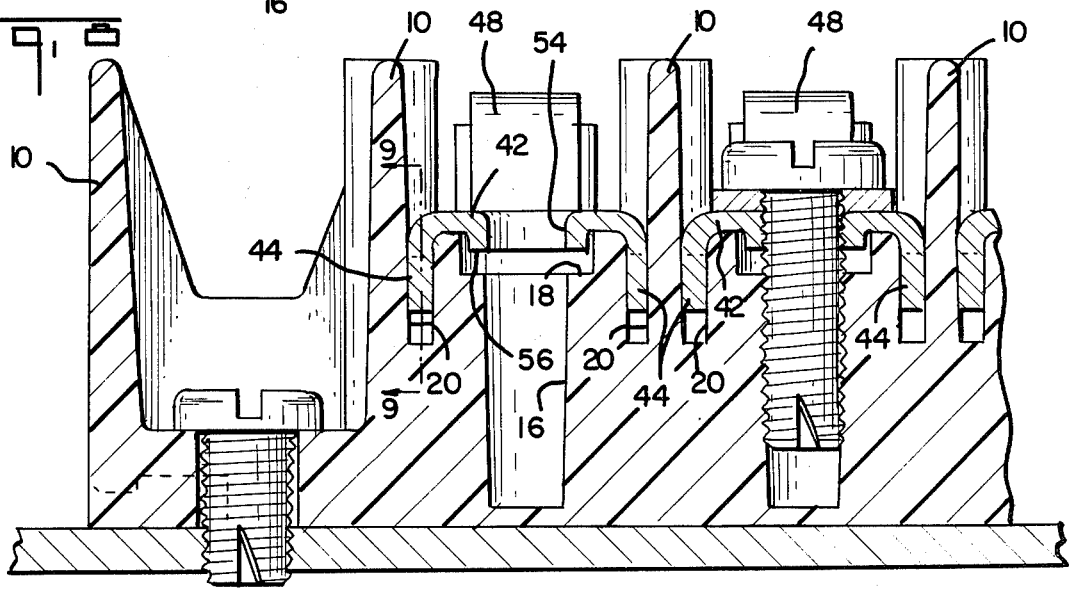
FIG. 8 is an enlarged fragmentary elevation similar to FIG. 4 and further illustrating the component parts of the invention mounted to the base.

Further with reference to FIGS. 1, 7 and 8, the terminal 4 includes a planar plate portion 42 having a pair of dovetail insert tabs 44 which are bent outwardly of the plane of the plate portion 42 to depend vertically therefrom. Each tab 44 includes a pair of oppositely projecting wedge shaped teeth 46 which bite into the thick web 12 upon forcible insertion of the tabs 44 within the corresponding recesses 20. The insert tabs 44 and 38 thereby provide positive retention of the terminal 4 in assembled configuration on the web 12 and on base bottom wall 8 between a pair of partition walls 10.

The terminal 4 may have various configurations. Each configuration includes a barrel contact 32 and a second wire receiving contact, such as the plate 42 connected to the barrel by a loop portion 48 of the terminal 4 which provides a sloped wire stop for the entrance to the barrel.

As shown in FIG. 7, a pair of wires 50 and 52 are electrically connected to the barrel by inserting end portions of the same transversely of their lengths slidably along the slot 34. The ends of the wires will engage the loop 48 which projects above the open end of the barrel and which guides or funnels the wire ends into the barrel. Opposite sides of the slot will slice through the insulation on each wire to engage and grip the conductor. In particular, the wire 50 will have its insulation sliced through and its conductor gripped between a first pair of opposed jaws defined on either side of the slot 34 and separated by the transverse slot 36 from a second pair of jaws on either side of the slot 34 which slice into and grip the wire 52. One slotted flange 24, shown in FIG. 2, will have its slot 26 in alignment with the barrel slot 34 to grip opposite sides of the wires and provide a strain relief. More specifically, the wires are inserted transversely of their lengths into the flange slot 26, the sides of the slot gripping the wires. The slot sides diagonally converge. If an inserted wire is pulled in a direction outwardly from the barrel terminal, the slot sides will tend to pivot into mutual alignment, narrowing the slot 26 to improve the grip on the wire and prevent its pull out from the terminal.

Further with reference to FIGS. 1 and 7, the second wire receiving contact in the form of the plate 42 may be provided with a central aperture 54 formed with a depending flange 56 which enters a corresponding counterbore 18. An electrical insulation covered conductor 56 is electrically connected to a ring terminal 60, the central aperture 58 of which receives a self-threading screw 62. The screw is further received through the plate aperture 54 and threadably driven and secured in the tapered recess 16.

Figures 11, 12, 17:
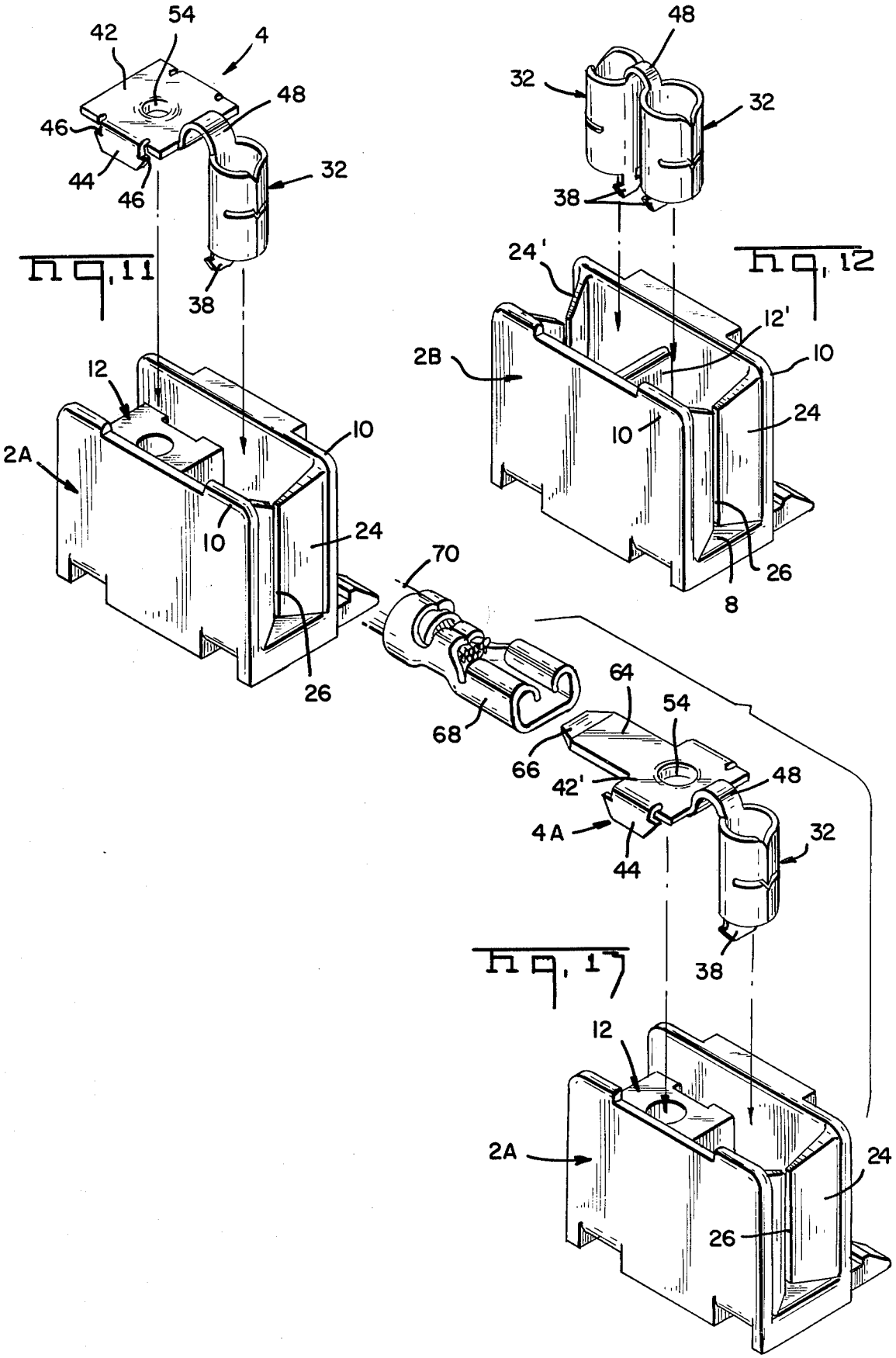
FIG. 11 is an enlarged perspective of a module according to the present invention.
FIG. 12 is an inlarged perspective of another embodiment of the module.

The terminal 4 is also shown in FIG. 11, in conjunction with a modified base module illustrated at 2A provided with a single pair of partition walls 10. Otherwise, the base module 2A is similar to base module 2 as having the web 12 and flange 24 between each pair of corresponding partitions 10.

FIG. 13 illustrates the base module 2A for use in conjunction with another embodiment of an electrical terminal illustrated at 4A. The terminal includes a barrel contact portion 32, a loop portion 48 and a modified plate 42 provided with an integral projecting blade or male electrical terminal portion 64. The end 66 of which is substantially chamfered on all surfaces. The modified terminal 4A is assembled to the base module 2A or the base A with the tabs 44 and 38 serving as locking inserts and retention tabs similar to the tabs previously described. The terminal portion 64 allows frictional electrical connection of a receptacle type electrical contact 68 which is electrically terminated to the conductor of an insulated wire shown generally at 70. The terminal 4A can also be assembled in the base 2 in place of a corresponding terminal 4.

FIG. 12 illustrates another connector module 2B used in conjunction with a modified electrical terminal 4B. The terminal 4B includes a pair of barrels 32 connected by a loop portion 48 which serves as a sloped wire stop at the entry of each of said barrels. Each barrel is provided with a depending insert tab 38, the details of which have been described. This tab is lockingly retained in a corresponding recess provided in a bottom wall 8 of the connector module 2B. The recesses receiving the tabs 38 are similar to the recess 30 of the base module 2. In the base module 2B a web 12 comprises a relatively thin vertical wall interconnecting the corresponding pair of partition walls 10 and adapted for receipt between the two barrels 32 of the terminal 4B.

Each of the base modules 2, 2A and 2B are provided with features which allow them to be interconnected or linked together. For example, one outermost partition wall 10 of each base module is provided with a projecting elongated flange 72 along the top edge thereof. The flange is generally L-shaped in section, with a free end spaced outwardly from the corresponding partition wall 10 and depending vertically downward. Along the bottom edge of the same outermost partition wall 10 is provided a pair of identical spaced wedged shaped latches 74 having vertical latching shoulders 76.

Figure 14:
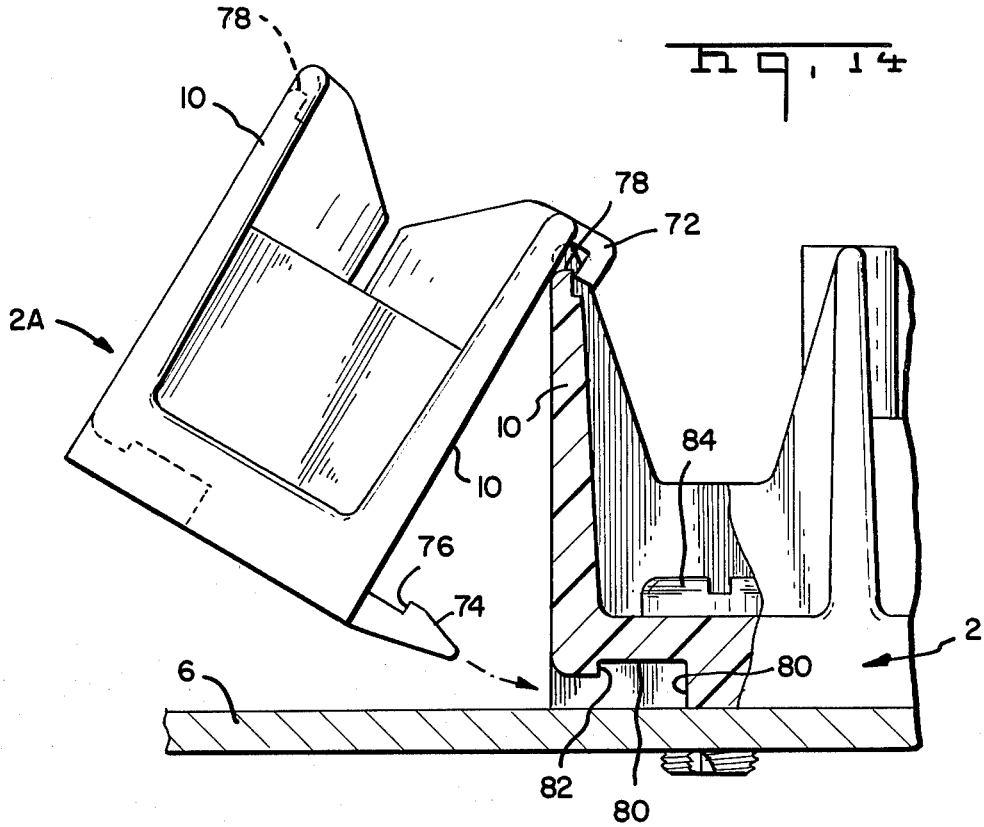
FIGS. 14 and 15 are enlarged fragmentary elevations in section illustrating the linking together of selected modules.
Figure 15:
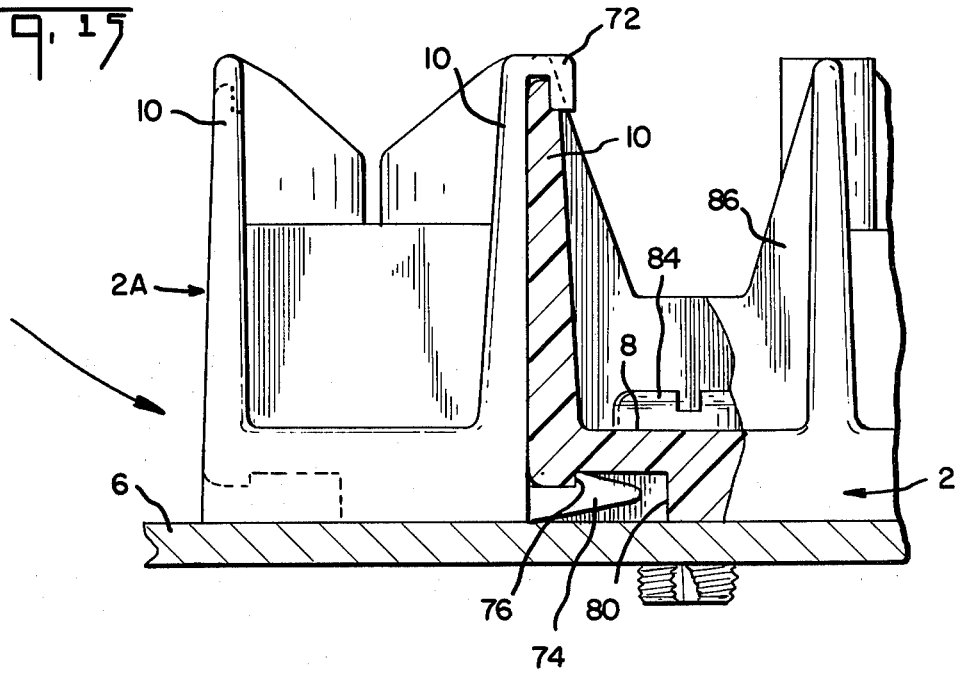

As shown in FIG. 14 each of the base modules 2 and 2A, and also 2B shown in FIG. 12, has the other outermost partition wall 10 provided along its top edge thereof with an elongated recess having a vertical depth to receive therein the vertical thickness of the flange 72 of another base module. In similar fashion, the outermost partition wall includes a pair of undercut recesses 80 provided with an inverted shoulder 82. Each recess 80 receives a corresponding latch 74 therein with the shoulder 76 of the latch lockingly engaged against the shoulder 82. Each base module may be linked to the other or to a duplicate one of itself as will be explained in conjunction with FIGS. 14 and 15. An exemplary module 2A is hooked to the module 2 by first hooking the flange 72 over the recess 78 and then pivoting the module 2A about the flange 72 so that the latches 74 enter the recesses 80 and latch therein as shown in FIG. 15.

The modules may be interconnected or linked together in the manner described, while the module 2 is permanently secured to the panel 6. The base module 2 is secured by threaded fasteners 84 provided through apertures 84 through the bottom wall 8. The partition walls 10 on either side of the apertures 84 are interconnected with webs 86. As shown, the webs 86 are different from the remaining webs 12 and the flanges 24. However, if desired one web 86 may be configured the same as the web 12. The other web 86 may have the same configuration as the flange 24.

Although preferred embodiments of the present invention have been described and shown in detail, other modifications and embodiments which would be apparent to one having ordinary skill in the art are intended to be covered by the spirit and scope of the claims.

What is claimed is:

1. A barrier block for commoning electrical wires or for providing a junction point for incoming and outgoing wires, comprising:

a housing having individual partition walls with adjacent pairs of said walls being interconnected by an integral web, an electrical terminal mounted on a respective web having a vertical hollow cylindrical barrel provided with a longitudinal slot divided into one or more pairs of opposed wire engaging and gripping jaws, each said terminal having a second wire receiving contact connected to said barrel by an integral loop serving as a sloped wire stop at the entry of said barrel, and strain relief flanges integral with said partition walls and having sides projecting diagonally toward each other to define a vertical wire receiving slot in alignment with said barrel slot.

2. The structure as recited in claim 1, wherein, one of said partition walls includes a hook along a top side thereof and a latch along a bottom side thereof, another of said partition walls includes a hook receiving first recess and a latch receiving second recess, so that said barrier block can hook and latch together with another like barrier block.

3. The structure as recited in claim 1, wherein, said second wire receiving contact includes a plate integral with said loop and provided with a vertical opening to receive a screw.

4. The structure as recited in claim 1, wherein, said second wire receiving contact includes a second barrel similar to said first mentioned barrel and integral with said loop portion which provides a sloped wire stop for both said barrels.

5. The structure as recited in claim 1, wherein, said second wire receiving contact includes a plate integral with said loop and provided with a projecting male electrical terminal for pluggable connection in a receptacle contact adapted for terminating a wire.

* * * * *